US010081465B2

(12) United States Patent
Biesecker Longacre et al.

(10) Patent No.: US 10,081,465 B2
(45) Date of Patent: Sep. 25, 2018

(54) CONTAINER ASSEMBLY AND CLOSURE WITH PREDETERMINED HUMIDITY AND RELATED METHOD

(71) Applicants: Lissa Biesecker Longacre, Boyertown, PA (US); Frederick N. Biesecker, II, Boyertown, PA (US); Douglas S. Camomile, Boyertown, PA (US); Bruce T. Cleevely, Boyertown, PA (US); Alex M. Warmkessel, Boyertown, PA (US); Robert Esse, Monticello, MN (US); Timothy H. Bohrer, Oregon, IL (US); Brian Rice, Greenfield, MN (US); Kyle A. Moll, Boyertown, PA (US); Eric Weller, Boyertown, PA (US)

(72) Inventors: Lissa Biesecker Longacre, Boyertown, PA (US); Frederick N. Biesecker, II, Boyertown, PA (US); Douglas S. Camomile, Boyertown, PA (US); Bruce T. Cleevely, Boyertown, PA (US); Alex M. Warmkessel, Boyertown, PA (US); Robert Esse, Monticello, MN (US); Timothy H. Bohrer, Oregon, IL (US); Brian Rice, Greenfield, MN (US); Kyle A. Moll, Boyertown, PA (US); Eric Weller, Boyertown, PA (US)

( * ) Notice: Subject to any disclaimer, the term of this patent is extended or adjusted under 35 U.S.C. 154(b) by 0 days.

(21) Appl. No.: 15/782,641

(22) Filed: Oct. 12, 2017

(65) Prior Publication Data

US 2018/0099797 A1 Apr. 12, 2018

Related U.S. Application Data

(60) Provisional application No. 62/422,317, filed on Nov. 15, 2016, provisional application No. 62/407,269, filed on Oct. 12, 2016.

(51) Int. Cl.
*B65D 81/26* (2006.01)
*B65D 51/30* (2006.01)
(Continued)

(52) U.S. Cl.
CPC ..... *B65D 51/30* (2013.01); *B65D 41/20* (2013.01); *B65D 50/04* (2013.01); *B65D 81/264* (2013.01)

(58) Field of Classification Search
CPC ..... B65D 41/20; B65D 50/04; B65D 51/30; B65D 81/264; B65D 81/266
(Continued)

(56) References Cited

U.S. PATENT DOCUMENTS 2,365,185 A * 12/1944 Gailey ..... A24F 25/02 206/204
3,135,566 A 6/1964 Frank
(Continued)

FOREIGN PATENT DOCUMENTS

WO 98/57321 A1 12/1998
WO 03/065821 A2 8/2003

OTHER PUBLICATIONS

Int'l Search Report and Written Opinion dated Jan. 9, 2018 in Int'l Application No. PCT/US17/56394.
(Continued)

*Primary Examiner* — Luan K Bui
(74) *Attorney, Agent, or Firm* — Panitch Schwarze Belisario & Nadel LLP

(57) ABSTRACT

A container assembly configured to maintain a predetermined humidity for storing a product therein. The container assembly includes a container having a body with a body wall and a mouth opening into a storage cavity and a cap having a top wall. The cap is selectively mountable over the mouth of the container to substantially enclose the storage
(Continued)

cavity in a mounted configuration. A sidewall extends substantially perpendicularly from one of the body wall and the top wall. The sidewall defines an opening and a compartment and has an opening edge adjacent the opening. A moisture control material is positioned within the compartment. A sealing membrane has a peripheral portion. The peripheral portion is secured to the sidewall proximate the opening edge. The sealing membrane is configured to allow moisture flow therethrough to maintain the predetermined humidity in the storage cavity.

15 Claims, 10 Drawing Sheets

(51) Int. Cl.
*B65D 50/04* (2006.01)
*B65D 41/20* (2006.01)

(58) Field of Classification Search
USPC ..... 206/204, 528, 540
See application file for complete search history.

(56) References Cited

U.S. PATENT DOCUMENTS 3,254,784 A * 6/1966 Lancesseur ..... B65D 51/30 215/228
3,820,309 A 6/1974 Cullen et al.
4,146,277 A 3/1979 Santoro
4,279,350 A * 7/1981 King ..... B65D 51/244 206/204
4,834,234 A * 5/1989 Sacherer ..... B65D 39/0023 206/204
5,114,003 A 5/1992 Jackisch et al.
5,936,178 A 8/1999 Saari
6,158,580 A 12/2000 Davis
6,244,432 B1 6/2001 Saari et al.
6,274,209 B1 * 8/2001 Pagidas ..... B65D 51/1616 206/204
6,571,942 B2 * 6/2003 Riemenschneider ..... B65D 81/266 206/204
6,921,026 B2 7/2005 Saari et al.
6,986,807 B2 1/2006 Brunk
7,475,773 B2 1/2009 Lancesseur et al.
8,590,719 B2 11/2013 Sprishen et al.
8,748,723 B1 6/2014 Egberg et al.
9,750,811 B2 9/2017 Egberg et al.
2004/0045969 A1 * 3/2004 Chiang ..... B65D 39/0023 220/521
2004/0224144 A1 11/2004 Saari et al.
2007/0114140 A1 * 5/2007 Portier ..... B65D 51/30 206/204
2008/0314772 A1 12/2008 Saari et al.
2010/0221393 A1 9/2010 Lim et al.
2011/0017615 A1 1/2011 Logel et al.
2011/0079525 A1 4/2011 Peck et al.
2013/0334074 A1 12/2013 Wada et al.
2014/0209488 A1 7/2014 Dai
2014/0339106 A1 11/2014 Schanin et al.
2015/0053579 A1 * 2/2015 Lebon ..... B65D 81/264 206/204
2015/0136618 A1 5/2015 Patel et al.
2015/0259115 A1 * 9/2015 Yeh ..... B65D 51/30 206/204
2015/0328584 A1 11/2015 Egberg et al.
2016/0031627 A1 2/2016 Yeh

OTHER PUBLICATIONS

Office Action dated Jun. 29, 2018 in U.S. Appl. No. 15/978,713, by Biesecker Longacre.

* cited by examiner

CONTAINER ASSEMBLY AND CLOSURE WITH PREDETERMINED HUMIDITY AND RELATED METHOD

CROSS-REFERENCE TO RELATED APPLICATIONS

The present application claims the benefit of U.S. Provisional Patent Application No. 62/422,317, filed Nov. 15, 2016 and titled, "Container Assembly with Predetermined Humidity and Related Method," the entire contents of which is incorporated herein by reference in its entirety. The present application also claims the benefit of U.S. Provisional Patent Application No. 62/407,269 ("269-APP"), filed on Oct. 12, 2016 and titled, "Device for Controlling Headspace Humidity and Methods for Making the Same" to the extent that subject matter from the 269-APP is expressly repeated herein.

BACKGROUND OF THE INVENTION

There is a need to keep pharmaceutical, health care and other products at a constant and regulated moisture level when they are stored in a container assembly. The packaging industry has been challenged to provide a package that is clean, a barrier to moisture vapor, child resistant and now having a means to keep the product fresh by maintaining a relatively consistent humidity within the container assembly. It is the freshness that has been the challenge as the packaging industry has already met the other requirements without much difficulty.

In order to keep contents fresh, controlling relative humidity at a specified level is preferred. The desired humidity or predetermined humidity to maintain freshness is variable in that different products prefer maintenance at different relative humidities. For example, some products are able to maintain freshness when kept dry or at zero or relatively close to zero relative humidity and other products maintain freshness when maintained at a relatively high level of humidity. The preferred invention addresses the maintenance of a predetermined relative humidity in a container assembly to maintain the freshness of a product held in the container assembly, which may be a pharmaceutical product, a health care product, a food product or nearly any product that may benefit from storage in a predetermined humidity environment.

For many packaged products, including packaged consumer products, it is beneficial to maintain a particular moisture content within the package containing the product. In some cases, the space within a product package that is not taken up by the product itself. Some devices are configured to help maintain a consistent relative humidity ("RH") of the space within the product package that is not taken up by the product itself. The RH may be maintained at a level or range deemed optimum for the particular packaged product. It is understood to those skilled in the art that the percent RH ("% RH") in the package will result in a percent by weight product moisture content, but that the % RH in the space not taken up by the product and the product percent moisture by weight are different values that differ based on the characteristics of the product and its propensity to absorb moisture from the surrounding atmosphere. Many products may be consumed or utilized by a consumer over a period of time, and maintaining a consistent RH may help preserve the life, integrity, freshness, flavor, or other features of the product.

One commonly used device for controlling RH in packaged products is a loose pouch containing a salt solution. As disclosed in U.S. Pat. No. 5,936,178, entitled Humidity Control Device, and filed Jun. 10, 1997, the contents of which are hereby incorporated by reference in their entirety, the RH of closed environments can be stabilized by the use of humidity control systems comprised of moisture permeable pouches containing specific salt solutions. However, this method of providing the humidity control feature through pouches that are loose in the product package creates inconvenience, potential contamination and perception disadvantages, such that manufacturers or consumers refuse to, or are prevented from, using this approach. For example, consumer confusion may arise as to whether the packet is something other than a humidity control device. In some cases, loose packets may be intentionally or mistakenly discarded by consumers when opening and closing the product packaging, particularly with repeated opening and closing of the packaging over time and opening or closing by consumers who are not familiar with the purpose of the pouch. Such approaches may also require specialized materials.

Dehumidification pouches have been utilized inside container assemblies to maintain the moisture level through absorbing the excess moisture. These pouches are stored in the container and intermingled with the product, such as pharmaceuticals or foods, in the container, resulting in surface contact between the pharmaceuticals, foods or other products and the pouches. Such intermingling and direct contact between the pouches and products are generally undesirable and consumers prefer not to have the pouches intermingled with the product such that the pouches fall out of the container when the consumer is dispensing products for use and the pouches come into direct contact with the stored products during storage and transport. There is no generally known system or method for adding and removing moisture to the contents of the container during typical use and appropriately isolating the RH control material.

The subject of this preferred invention is directed to packaging that has made it possible for a container to incorporate addition and removal of moisture from the container assembly during normal use, without including the pouch or humidity control material intermingled with the contents of or product in the container. The preferred invention allows for the preservation of substances and objects sensitive to humidity, such as particular foods, pharmaceuticals, and herbs. Particularly, the preferred invention relates to devices for controlling the relative humidity within consumer product packages, and methods for making such devices, wherein the humidity control material is contained in a compartment associated with the product packaging.

BRIEF SUMMARY OF THE INVENTION

Briefly stated, the preferred invention is directed to a container assembly with a predetermined humidity, wherein the container assembly includes a container, a cap, a sealing membrane and a moisture controlling material. The container has a body, a neck, a mouth and external threads extending from the neck. The mouth is positioned adjacent a top end of the neck. The cap has a substantially circular top wall, a compartment adjacent the top wall and a downwardly depending skirt with an internal surface. Internal threads extend from the internal surface. The sealing membrane has a peripheral surface or portion secured to the cap. The compartment is defined by the top wall and the sealing membrane. The moisture controlling material is contained within the compartment. The sealing membrane is configured to allow moisture flow therethrough to maintain the predetermined humidity in the container.

In another aspect, the preferred invention is directed to a container assembly configured to maintain a predetermined humidity for storing a product therein. The container assembly includes a container having a body with a body wall and a mouth opening into a storage cavity and a cap having a top wall. The cap is selectively mountable over the mouth of the container to substantially enclose the storage cavity in a mounted configuration. A sidewall extends substantially perpendicularly from one of the body wall and the top wall. The sidewall defines an opening and a compartment and has an opening edge adjacent the opening. A moisture control material is positioned within the compartment. A sealing membrane has a peripheral surface or portion. The peripheral surface or portion is secured to the sidewall proximate the opening edge. The sealing membrane is configured to allow moisture flow therethrough to maintain the predetermined humidity in the storage cavity.

In a further aspect, the preferred invention is directed to a container assembly configured to maintain a predetermined humidity for storing a product therein. The container assembly includes a container having a body with a body wall, a neck, external threads extending from the neck and a mouth opening into a storage cavity. The mouth is positioned adjacent a top end of the neck. The container assembly also includes a cap having a top wall, a downwardly depending skirt with internal threads and a downwardly depending sidewall extending downwardly from the top wall inwardly relative to the skirt. The cap is selectively mountable over the mouth of the container to substantially enclose the storage cavity in a mounted configuration by engaging the internal and external threads. The sidewall defines an opening and a compartment. The sidewall includes an opening edge adjacent the opening. A moisture control material is positioned within the compartment. A sealing membrane has a peripheral surface or portion. A compartment lid has a lid edge, a cavity surface, a compartment surface and a perforation extending between the cavity surface and the compartment surface. The compartment lid is connected to the sidewall proximate the opening edge with the compartment surface facing the compartment and the cavity surface facing the cavity. The sealing membrane is attached to the compartment surface with the peripheral surface or portion adjacent the lid edge. The sealing membrane is configured to allow moisture flow therethrough to maintain the predetermined humidity in the storage cavity.

BRIEF DESCRIPTION OF THE SEVERAL VIEWS OF THE DRAWINGS

The foregoing summary, as well as the following detailed description of a preferred embodiment of the container or cap assembly of the present invention, will be better understood when read in conjunction with the appended drawings. For the purposes of illustrating the preferred container or cap assembly, preferred embodiments of the present invention are shown in the drawings. It should be understood, however, that the description is not limited to the precise arrangements and instrumentalities shown. In the drawings.

DETAILED DESCRIPTION OF THE INVENTION

Figure 1:
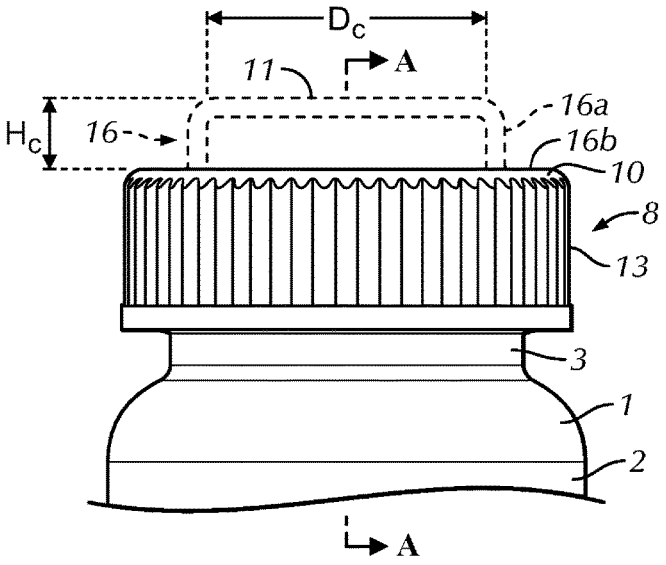
FIG. 1 is a partial side elevational view of a container assembly in accordance with preferred embodiments of the present invention.

Certain terminology is used in the following description for convenience only and is not limiting. Unless specifically set forth herein, the terms "a", "an" and "the" are not limited to one element but instead should be read as meaning "at least one". The words "right", "left", "lower" and "upper" designate directions in the drawings to which reference is made. The words "inwardly" or "distally" and "outwardly" or "proximally" refer to directions toward and away from, respectively, the container assembly, the container, the cap and related parts thereof. The words, "anterior", "posterior", "superior," "inferior", "lateral" and related words and/or phrases designate preferred positions, directions and/or orientations to which reference is made and are not meant to be limiting. The terminology includes the above-listed words, derivatives thereof and words of similar import.

It should also be understood that the terms "about," "approximately," "generally," "substantially" and like terms, used herein when referring to a dimension or characteristic of a component of the preferred invention, indicate that the described dimension/characteristic is not a strict boundary or parameter and does not exclude minor variations therefrom that are functionally the same or similar, as would be understood by one having ordinary skill in the art. At a minimum, such references that include a numerical parameter would include variations that, using mathematical and industrial principles accepted in the art (e.g., rounding, measurement or other systematic errors, manufacturing tolerances, etc.), would not vary the least significant digit.

As used herein, the terms "container" and "container assembly" refer to rigid or semi-rigid containers, such as bottles or jars, constructed primarily of polymeric, plastic or glass materials. Some of the rigid or semi-rigid materials may include, but are not limited to, polypropylene ("PP"), low or high density polyethylene, polyvinyl chloride ("PVC"), polystyrene and polyethylene terephthalate ("PET"). Such containers do not include containers constructed primarily of paper, paperboard materials, foldable plastics or other flexible or foldable materials, but may include plastics having living hinges constructed of polymeric materials. It is to be appreciated that "container" and "container assembly" do not include pouches, envelopes, boxes or containers constructed with foldable, flexible or non-rigid materials, but may include containers, closures and container assemblies having living hinges constructed of polymeric materials. Moreover, as used herein, a "container" or "container assembly" is a jar, closure or bottle having a removable cap configured to engage an opening or mouth of the bottle, closure or jar. For example, the cap may have threading configured to engage with the threading of the bottle, closure or jar.

Figure 2:
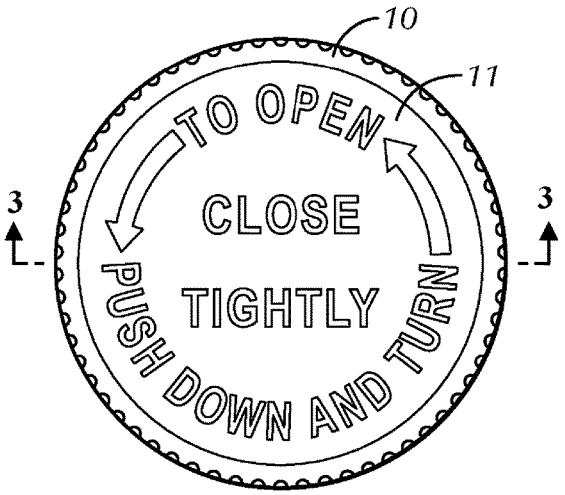
FIG. 2 is a top plan view of a cap of the container assembly of FIG. 1.

Referring to FIGS. 1-2, preferred embodiments of the present invention are directed to a container assembly 8 including a rigid or semi-rigid container 1 and a cap 10. The preferred container assemblies 8 are configured to maintain a predetermined humidity for storing a product therein. The container assembly 8 includes the container 1 having a body 2, a neck 3, a mouth 5 and external threads 4 extending from the neck 3. The mouth 5 is positioned adjacent a top end 3*a* of the neck 3. The container assembly 8 also includes a cap 10 having a substantially circular top wall 11 and a downwardly depending skirt 13 with an internal surface 13*a*. Internal threads 14 extend from the internal surface 13*a*. The internal threads 14 are preferably, selectively engageable to the external threads 4 to selectively secure the cap 10 to the container 1. The container 1 also preferably includes a storage cavity 6 therein that is defined by the body 2 and is configured to store or hold the product therein. The cap 10 may be a child-resistant cap that resists opening by a child, but is not so limited and may be comprised of nearly any cap 10 that is able to selectively mount to the container 1. The container 1 and cap 10 are not limited to having the configuration and features shown in FIGS. 1-2 and described above and may be comprised of nearly any container having nearly any version of a cap that is able to close a mouth of the container to secure a product therein.

The container 1 and cap 10 are preferably formed of a rigid polymeric material such as polypropylene (PP), though other materials such as low or high density polyethylene, polyvinyl chloride (PVC), polystyrene, polyethylene terephthalate (PET), nylon, and the like may be similarly used. The container 1 and cap 10 are preferably constructed of a material that is resistant to flow of moisture therethrough, is relatively durable and has sufficient strength to perform the functions and withstand the normal operating conditions of the cap 10 and container 1. The container 1 and cap 10 are not limited to constructions using the above-described polymeric materials and may be constructed of nearly any material that is able to take on the general size and shape of the preferred cap 10 and container 1, withstand the normal operating conditions of the cap 10 and container 1 and perform the preferred functions of the cap 10 and container 1.

Figure 3:
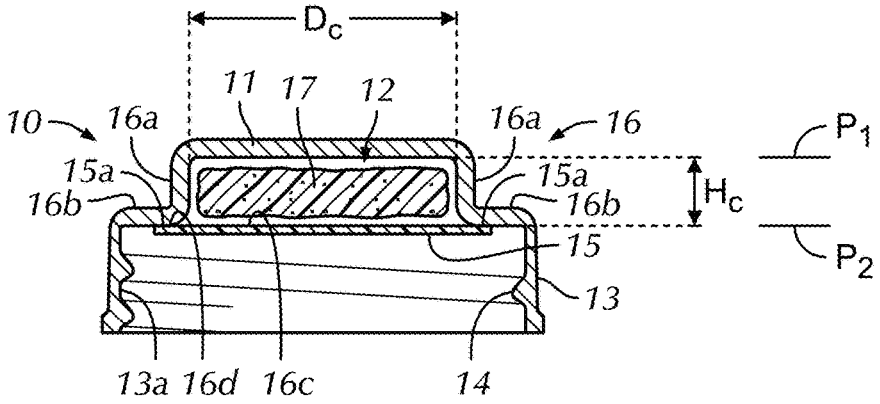
FIG. 3 is a cross-sectional view of the cap of FIG. 2, taken along line 3-3 of FIG. 2 and showing a cap in accordance with a first preferred embodiment of the present invention.

Referring to FIGS. 1-3, in a first preferred embodiment, the cap 10 includes a compartment 12 adjacent or formed in the top wall 11. The compartment 12 preferably extends above a substantially horizontal wall 16*b* of the top wall 11 that extends inwardly from a top portion of the downwardly depending skirt 13. The first preferred container assembly 8 and, preferably, the first preferred cap 10 also includes a sealing membrane 15 having a peripheral portion, surface or surface band 15*a* that begins at the outside peripheral edge and extends inwardly toward the center of the sealing membrane 15. The peripheral portion 15*a* is secured to the cap 10 in the first preferred embodiment, but is not so limited. The sealing membrane 15 may alternatively be secured to the container 1 without significantly impacting the function of the container assembly 8 and the overall inventive concept described herein, such as is described in greater detail below in a seventh preferred container assembly 708. In the first preferred embodiment, the compartment 12 is defined by the top wall 11, particularly a substantially vertical wall 16*a* of the top wall 11, a central portion of the top wall 11 and the sealing membrane 15 and, therefore, is associated with the cap 10. The compartment 12 may, alternatively, be formed in the container 1.

In the first preferred embodiment, the cap 10 includes a containment structure 16 between the central portion of the top wall 11 and the skirt 13. The containment structure 16 includes the substantially vertical wall 16*a*, the substantially horizontal wall 16*b* that connect the central portion of the top wall 11 to the skirt 13 and the top wall 11 that define the compartment 12 and support the moisture controlling material 17 in the compartment 12. The containment structure 16 is preferably constructed of a rigid or semi-rigid polymeric or plastic material to structurally support and contain the moisture controlling material 17. The containment structure 16 limits any transfer of moisture and air therethrough, particularly when compared to the sealing membrane 15, which permits transfer of moisture and air between the compartment 12 and the storage cavity 6 where the product is stored. The extension of the vertical wall 16*a* and central portion of the top wall 11 are shown in FIG. 1 in dashed line-type so that FIG. 1 can also be utilized to represent the caps of the additional preferred embodiments, which are described in greater detail below. The cap 10 is not limited to including the containment structure 16 and may be configured such that the top wall 11 does not include the substantially vertical wall 16*a*. The containment structure 16 is configured such that the peripheral portion 15*a* of the sealing membrane 15 is readily heat sealable to the substantially horizontal wall 16*b*. In the first preferred embodiment, the compartment 12 is defined and bounded by the sealing membrane 15, the substantially vertical wall 16*a* and the central portion of the top wall 11. The generally moisture resistant material of the top wall 11 and the substantially vertical wall 16*a* resist significant flow of moisture therethrough, while the sealing membrane 15 accommodates flow of moisture therethrough into and out of the compartment 12 and into and out of the storage cavity 6 of the container 1 when the cap 10 is secured to the container 1 in the mounted configuration (FIG. 1). In addition, in a mounted or closed configuration, the materials of the outside portion of the top wall 11 and the container 1, generally resist moisture flow therethrough, such that a predetermined relative humidity or range may be maintained in the storage cavity 6 where the product is stored.

The first preferred container assembly 8 also includes a moisture controlling material 17 contained or positioned within the compartment 12. The sealing membrane 15 is configured to allow moisture flow therethrough to maintain a predetermined humidity in the storage cavity 6 of the container 1 when the cap 10 is mounted to the container 1. The moisture controlling material 17 is preferably configured to maintain a predetermined humidity within the container assembly 8 when the cap 10 is mounted to the container 1. The predetermined humidity is preferably selected based on the product that is stored in the container assembly 8, such as a pharmaceutical, tobacco, plants, food, popcorn, herbs, spices, dried fruits, supplements, herbal remedies, medical materials, cannabis, medical marijuana, recreational marijuana, or other products that may be stored in rigid or semi-rigid polymeric, plastic or glass containers at predetermined humidities and such predetermined humidity storage provides potential advantages for the product, such as freshness. The predetermined humidity is preferably not a specific predetermined relatively humidity number having a specific and finite unit, but is preferably comprised of a range of relative humidity that is preferably maintained within the storage cavity 6, based on the material or product that is stored in the storage cavity 6.

In the first preferred embodiment, the moisture controlling material 17 is comprised of a material that both 1) removes moisture and 2) adds moisture across the sealing membrane 15 to maintain a substantially consistent predetermined humidity or predetermined humidity range in the storage cavity 6 when the cap 10 is mounted to the container 1 in the mounted configuration. The challenge to the packaging producer and designer is to provide the container assembly 8 that will both dehumidify and add moisture. The moisture controlling material 17 is preferably comprised of a viscous liquid 17 that is secured in the compartment 12, but is not so limited and may be comprised of nearly any type of material that is able to maintain the preferred predetermined humidity or generally maintain the predetermined humidity in the storage cavity 6 for an amount of time. The moisture controlling material 17 may be comprised of saturated aqueous salt with alkali metal formate therein or other materials that promote maintenance of a predetermined humidity for a period of time. The moisture or humidity controlling material 17 may also be comprised of a one-way humidity control material 17, as desired by the designer or user.

The quantity of humidity control material or agent 17 contained within the compartment 12 may vary based on desired RH control capacity, size of product package or container assembly 8, and/or other factors. The quantity of humidity control agent 17 may vary from, for example, less than one gram (1 g) to more than ten grams (10 g) of material for each container assembly 8. It may be advantageous to achieve a workable balance between the "footprint" of the humidity control agent 17 and its thickness. Too large a footprint, while reducing thickness, may increase a width and length of the compartment 12 and thus require different volume and sizes.

The humidity control agent 17 may be comprised of a solid, a dispersion, an emulsion, a gel, or a saturated or unsaturated aqueous solution comprised of a salt, sugar, polyol such as glycerin or propylene glycol, mannitol, sorbitol, xylitol, amino acid, or other solute modulating the relative humidity. For example, in some embodiments, the humidity control agent 17 may be or include a saturated or unsaturated salt solution, such as those described in U.S. Pat. No. 9,750,811, entitled Devices and Methods for Controlling Headspace Humidity and Oxygen Levels, filed Sep. 15, 2015 and/or U.S. Pat. No. 5,936,178, entitled Humidity Control Device, filed Jun. 10, 1997, the content of each of which is hereby incorporated herein by reference in their entirety. In other embodiments, other suitable materials for controlling humidity may be used as the humidity control agent 17. The humidity control agent 17 may allow for one-way or two-way humidity control in some embodiments. That is, the humidity control agent 17 may be configured to remove moisture from the air and/or to add moisture to the air within the storage cavity 6. In some embodiments, one or more additives may be combined with the humidity control agent 17, including but not limited to the additives described in U.S. Pat. Nos. 9,750,811 and/or 5,936,178. For example, some additives may be used to increase or otherwise control viscosity levels of the humidity control agent 17 or other features of the humidity control agent 17, as would be desirable for the designer or user.

The sealing membrane 15 is preferably constructed of a polymeric or composite film that breathes to transport moisture vapor in both directions or in one direction across the sealing membrane 15, but contains the moisture controlling material 17, preferably without leaking liquid or relatively viscous liquid moisture controlling material 17 into the storage cavity 6. The water vapor transport, known as water vapor transmission rate ("WVTR") is measured in terms of grams of water passed per one hundred square inches (100 $in^2$) of material per twenty-four hours (24 hrs) under standard test conditions. It is a function of the type of film used and the thickness of the film of the sealing membrane 15. The total moisture transferred is also determined by the area of the sealing membrane 15 exposed to a humidity control solution in a given application. It has been shown that a WVTR of about ten grams (10 g) water per one hundred square inches (100 $in^2$) over twenty-four hours (24 hrs) provides good results for a device in accordance with the preferred invention. Packaging film materials that may be employed for the sealing membrane 15 include polyvinylchloride, fibrous polyethylene, such as TYVEK or flashspun high-density polyethylene fibers or a film, cellophane, polycarbonate, thin polyolefin, oriented polystyrene, polyfluorocarbon, or polyester, such as the elastomer Hytrel laminated onto a suitable substrate such as paper. The sealing membrane 15 may also comprise polyamide nylon film, such as Capran, styrene-butadiene copolymer, such as K-Resin, cellulose acetate, polyethylene terephthalate, such as Mylar, ethylene vinyl acetate, or ethylene vinyl alcohol. In some embodiments, a thermoplastic polyester elastomer may be used as or with the permeable layer or sealing membrane 15. Such thermoplastic polyester elastomer materials for use as the sealing membrane 15 preferably have been found to offer a combination of high water vapor permeability, resistance to solutions, such as salt solutions for example, toughness, and the ability to create relatively strong and robust seals with itself. Other materials that may be used as or included with the sealing membrane 15 may include, but are not limited to, paper, foil, polyesters, metalized polyesters, copolyesters, polyolefins, copolymers, and/or other suitable materials. In some embodiments, the permeable layer 15 may be or include a microperforated material or any other suitable material configured to maintain the humidity control agent 17 at static and/or dynamic pressures encountered during product filling, distribution, storage, and customer use of the packaged product.

The sealing membrane 15 is not limited to constructions of polymeric or composite films, as described above, and may be comprised of any barrier, container or material that is able to take on the general size and shape of the sealing membrane 15, withstand the normal operating conditions of the sealing membrane 15 and/or perform the preferred functions of the sealing membrane 15, such as transporting water vapor across the sealing membrane 15 while retaining the moisture controlling material 17 within the compartment 12.

In the preferred embodiment, the compartment 12 has a compartment volume that is configured to accommodate the moisture controlling material 17 in an amount sufficient to maintain the predetermined humidity of the storage cavity 6. The sealing membrane 15 also defines a surface area that is configured to allow the moisture flow at a sufficient rate to maintain the predetermined humidity in the storage cavity 6 of the container 1 in the mounted configuration. The compartment 12 of the preferred container assembly 8 of the first preferred embodiment has a compartment diameter $D_C$ and a compartment height or sidewall height $H_C$. The compartment volume is, therefore, $\Pi\ (D_C^2/4)\ H_C$ and the surface area is, therefore, $\Pi\ (D^2/4)$. For example, the preferred compartment diameter $D_C$ may be approximately twenty-five millimeters (25 mm) and the compartment height $H_C$ may be approximately five millimeters (5 mm), resulting in a compartment volume of two and forty-five hundredths cubic centimeters (2.45 $cm^3$) and a surface area of four and nine tenths square centimeters (4.9 $cm^2$). The preferred compartment 12 is not limited to the described dimensions, but the described dimensions are provided as a non-limiting example.

The cap 10 of the first preferred embodiment has a melt bead positioned at the peripheral portion 15*a* of the sealing membrane 15 in the mounted configuration. The melt bead is configured for melting upon application of sufficient heat to the peripheral portion 15*a* to secure the sealing membrane 15 to the cap 10 by heat sealing. The first preferred configuration of the substantially horizontal wall 16*b* of the containment structure 16 accommodates the melt bead in a position that is readily accessible during manufacturing for application of heat to the melt bead and peripheral surface or portion 15*a* to heat seal the sealing membrane 15 to the cap 10, specifically to the horizontal wall 16*b* near the compartment 12. The sealing membrane 15 is not limited to being secured to the cap 10 by the melt bead and the application of heat to the melt bead and may be otherwise fastened, adhesively bonded, induction sealed, clamped, integrally molded or otherwise secured to the cap 10 to define the compartment 12 with the moisture controlling material 17 therein.

The first preferred container assembly 8 utilizes the compartment 12, either in the container 1 or in the cap 10, providing space for the moisture controlling material 17 in the proper amount to satisfactorily condition the total volume of the storage cavity 6 of the container 1. This space in the compartment 12 is sealed with the sealing membrane 15 to maintain the moisture controlling material 17 in the compartment 12 (not leaking) and at the same time allow moisture vapor to travel in and out of the compartment 12 or only one way through the sealing membrane 15.

The compartment 12 once filled with the moisture controlling material 17 is sealed with the sealing membrane 15, specifically developed to hold the material 17 in the compartment 12 while allowing moisture vapor to pass through. The seal is preferably formed by an iron or other heat applying mechanism that provides enough heat to achieve melting of the sealing bead of the cap 10 onto the sealing membrane 15. The compartment 12 can be anywhere on the container assembly 8 that is substantially isolated from the external environment, but exposed to the internal volume or storage cavity 6 of the container 1 through the sealing membrane 15. The first preferred embodiment has the compartment 12 designed inside or under the top wall 11 of the cap 10 that is surrounded by the generally moisture resistant containment structure 16 that extends away from the storage cavity 6 in a mounted configuration, but is not so limited. For example, the cap 10 may have a depression in the top wall 11 sufficient to hold the moisture controlling material 17 and a couple of small melt beads around the outside diameter of the cap 10 that would melt when the hot iron is placed on the top side of the sealing membrane 15 thus sealing the sealing membrane 15 to the cap 10 and may similarly be configured for a compartment 12 in the container 1.

In the first preferred embodiment, the body 2 of the container 1 includes a body wall 2*a* that is constructed of a material that substantially prevents flow of moisture therethrough. The cap 10 may also include a seal or sealing material (not shown) on an inner surface that mates with the top end 3*a* of the neck 3 to limit flow of moisture between the ambient air and the air in the storage cavity 6. The cap 10 is selectively mountable over the mouth 5 of the container 1 to substantially enclose the storage cavity 6 in the mounted configuration. The mouth 5 is preferably positioned adjacent the top end 3*a* of the neck 3, such that the cap 10 covers the mouth 5 in the mounted configuration.

In the first preferred embodiment, the vertical wall 16*a* is comprised of a sidewall 16*a* that extends substantially perpendicularly from the top wall 11 and the horizontal wall 16*b*. The sidewall 16*a* defines an opening 16*c* and the compartment 12, wherein the opening is preferably located between the compartment 12 and the storage cavity 6 in the mounted configuration. The sidewall 16*a* includes an opening edge 16*d* formed adjacent the opening 16*c* at the intersection of the sidewall 16*a* and the horizontal wall 16*b* of the top wall 11 in the first preferred embodiment. The peripheral portion 15*a* of the sealing membrane 15 preferably mates with the opening edge 16*d* of the cap 10 wherein the sealing membrane 15 is secured to the cap 10. The peripheral portion 15*a* is preferably secured to the sidewall 16*a* proximate the opening edge 16*d* when the sealing membrane 15 is secured or attached to the cap 10 in the first preferred embodiment.

The compartment 12 of the first preferred embodiment is defined by the vertical wall or sidewall 16*a*, the central portion of the top wall 11 and the sealing membrane 15, wherein the sidewall 16*b*, the top wall 11, the horizontal wall 16*a* and the skirt 13 are integrally formed or molded. The compartment 12 is not limited to such formation or configuration and may be comprised of a separate component or structure that is adhered, secured or attached to a top wall of the cap that is not integrally formed with the cap (not shown). In addition, the compartment 12 may be formed by a separate structure that is adhered, fastened or otherwise secured to the inside of the container 1 with the sealing membrane 15 facing the storage cavity 6 to allow flow of moisture between the storage cavity 6 and the compartment 12.

The cap 10 of the first preferred embodiment includes the horizontal wall 16*b*, which is a portion of the top wall 11 and the central portion of the top wall 11 that is separated from the horizontal wall 16*b* by the sidewall 16*a*. The sidewall 16*a* extends away from the outer portion of the top wall 11 or the horizontal wall 16*b* and the storage cavity 6 in the mounted configuration. The top wall 11, therefore, includes the central portion of the top wall 11 and the outer portion of the top wall 11 or the horizontal wall 16*b* that are separated by the sidewall 16*a*. The central portion of the top wall 11 may be considered a first wall portion that defines a first plane $P_1$ and the outer portion of the top wall 11 or the horizontal wall 16*b* may be considered a second wall portion that defines a second plane $P_2$. The first plane $P_1$ is separated from the second plane $P_2$ by the sidewall height $H_C$.

Figure 5:
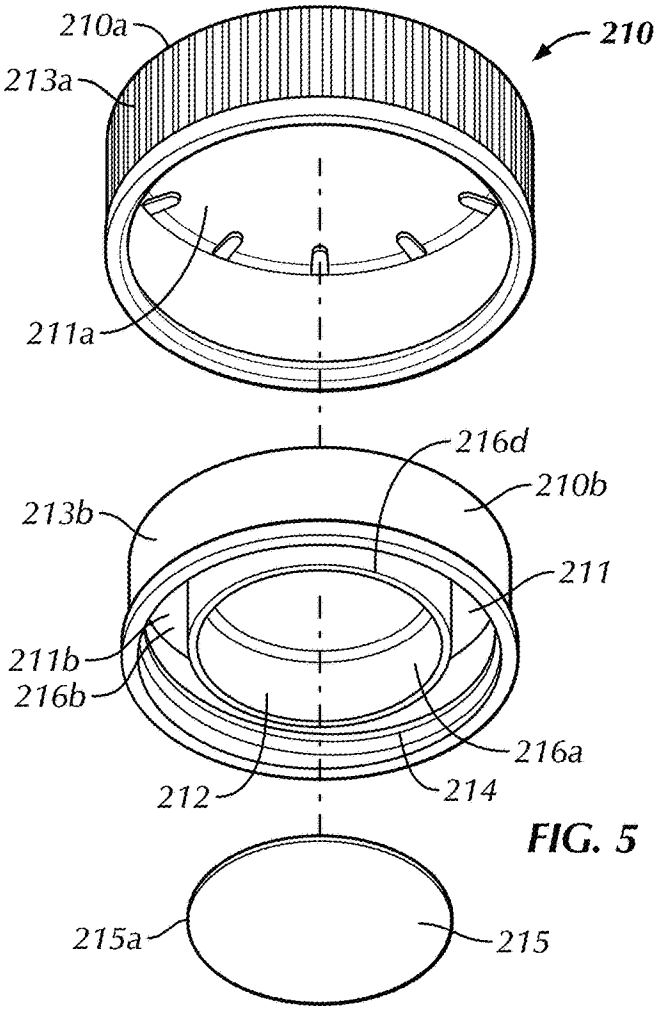
FIG. 5 is a side perspective, exploded view of the cap of the container assembly of FIG. 4.
Figure 4:
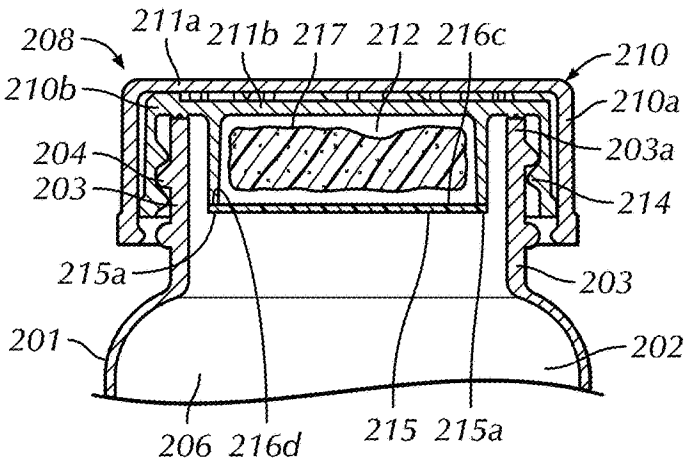
FIG. 4 is a cross-sectional view of the container assembly of FIG. 1, taken along line A-A of FIG. 1 and showing a cap and a container in a mounted configuration in accordance with a second preferred embodiment of the present invention.

Referring to FIGS. 1, 4 and 5, a second preferred container assembly 208 has a similar construction to the first preferred container assembly 8 and like reference numbers are utilized to identify like features of the second preferred container assembly 208 with a number "2" prefix utilized to distinguish the features of the container assembly 8 of the first preferred embodiment from the container assembly 208 of the second preferred embodiment. The second preferred container assembly 208 may include a rigid or semi-rigid container 201.

The cap 210 of the second preferred embodiment is comprised of a child-resistant cap 210 having an outer cap 210*a* and an inner cap 210*b*. The outer cap 210*a* preferably rotates or pivots relative to the inner cap 210*b* unless a particular force is applied to the outer cap 210*a* relative to the inner cap 210*b* to engage features of the caps 210*a*, 210*b* that result in co-rotation of the outer and inner caps 210*a*, 210*b* to release the cap 210 from the container 201. The two-part cap 210 may be comprised and operate similarly to the two-part cap described in U.S. Pat. No. 8,590,719, which is incorporated herein by reference, or other two-part child resistant closures or caps. The cap 210 also preferably includes an outer skirt 213*a* and an inner skirt 213*b*. The sidewall 216*a* preferably extends downwardly and generally perpendicularly from an inner top wall 211*b* of the inner cap 211, with an outer top wall 211*a* positioned proximate the inner top wall 211*b* in an assembled configuration. The sidewall 216*a* is not limited to extending substantially perpendicularly from the inner top wall 211*b* and may extend at an alternative angle or have an alternative configuration, as long as the sidewall 216*a* assists in defining the compartment 212. The outer and inner top walls 211*a*, 211*b* are preferably, substantially circular, with the outer and inner skirts 213*a*, 213*b* extending downwardly from peripheral portions of the outer and inner top walls 211*a*, 211*b*, respectively. The inner skirt 213*b* preferably includes the internal threads 214 that releasably engage the external threads 204 of the container 201. The internal threads 214 preferably extend inwardly from an internal surface of the inner skirt 213*b*. The inner skirt 213*b* and the outer skirt 213*a* are preferably positioned outwardly relative to the sidewall 216*a* in the assembled configuration (FIG. 4).

In the second preferred embodiment, the sidewall 216 has the opening edge 216*d* spaced from the inner top wall 211*b* that defines the opening 216*c*. The sealing membrane 215 is secured to the opening surface or portion 216*d* at the peripheral portion 215*a* of the sealing membrane 215 to container the moisture controlling material 217 in the compartment 212. The sidewall 216*a* of the second preferred embodiment is integrally formed with the inner cap 210*b*, but is not so limited and may be comprised of a separate structure that defined the compartment 212 and is secured, fastened, adhesively bonded or otherwise attached to the cap 210 or the container 201 such that humidity is maintained in the storage cavity 206.

Figure 7:
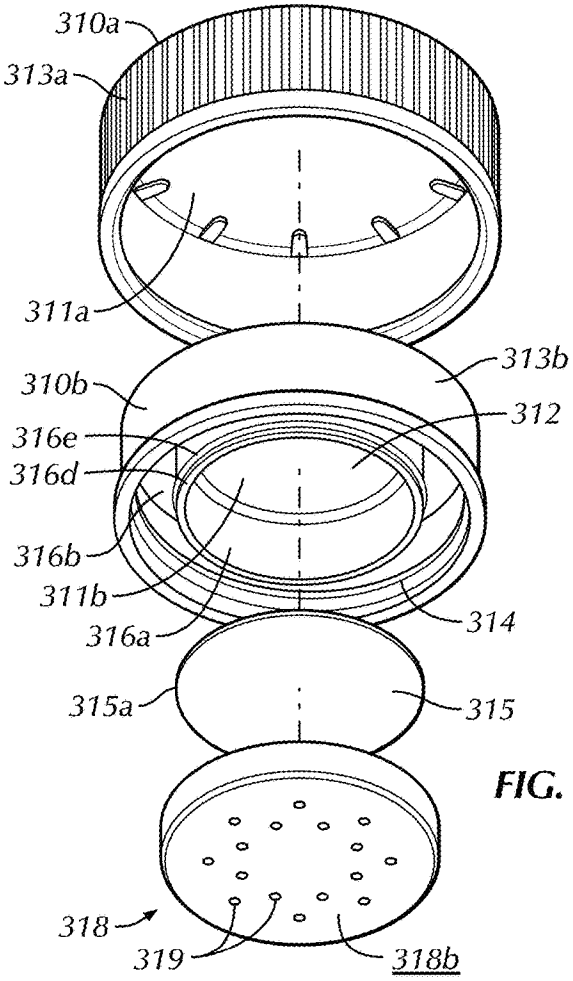
FIG. 7 is a side perspective, exploded view of the cap of the container assembly of FIG. 6.
Figure 6:
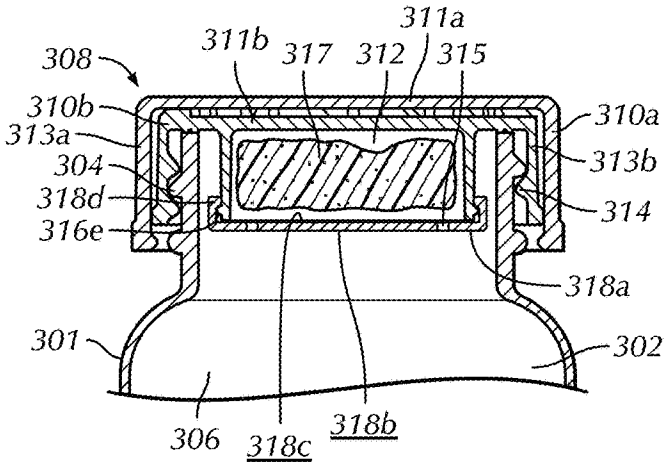
FIG. 6 is cross-sectional view of the container assembly of FIG. 1, taken along line A-A of FIG. 1 and showing a cap and a container in a mounted configuration in accordance with a third preferred embodiment of the present invention.

Referring to FIGS. 1, 6 and 7, a third preferred container assembly 308 has a similar construction to the first and second preferred container assemblies 8, 208 and like reference numbers are utilized to identify like features of the third preferred container assembly 308 with a number "3" prefix utilized to distinguish the features of the container assemblies 8, 208 of the first and second preferred embodiments from the container assembly 308 of the third preferred embodiment. The third preferred container assembly 308 may include a rigid or semi-rigid container 301.

The third preferred container assembly 308, similar to the second preferred embodiment, is comprised of a two-part child resistant cap 310 having the inner cap 310*b* and the outer cap 310*a*. The compartment 312 is preferably defined by the inner top wall 311*b*, the sidewall 316*b* and the sealing membrane 315. The moisture controlling material 317 is preferably positioned in the compartment 312 in the assembled configuration (FIG. 6). The third preferred container assembly 308 also preferably includes a compartment lid 318 having a lid edge 318*a*, a cavity surface 318*b* and a compartment surface 318*c*. The compartment lid 318 is preferably connected to the sidewall 316*a* proximate the opening edge 316*d* with the compartment surface 318*c* facing the compartment 312 and the cavity surface 318*b* facing the storage cavity 306 when the cap 310 is mounted to the container 301 in the mounted configuration. The compartment lid 316 of the third preferred embodiment also includes an engagement hook 318*d* at a peripheral section that mates with a counterpart engagement hook 316*e* on the sidewall 316*a* to secure the compartment lid 318 to the sidewall 316*a* and the inner cap 310*b*. The sealing membrane 315 is preferably secured between the compartment lid 318 and the opening edge 316*d* in the assembled configuration to secure the sealing membrane 315 to the inner cap 310*b*.

In the third preferred embodiment, the sealing membrane 315 is secured to the compartment surface 318*c* of the compartment lid 318, such as by adhesive bonding, fastening, clamping or other securing mechanisms. The compartment lid 318 may then be quickly assembled to the sidewall 316*a* by urging the compartment lid 318 toward and onto the sidewall 316*a* such that the engagement hook 318*d* attaches to the counterpart engagement hook 316*e*.

The compartment lid 318 of the third preferred embodiment has a substantially circular, disc-like shape with the engagement hook 318*d* extending generally perpendicular and away from the compartment surface 318*c*. The opening edge 316*d* of the sidewall 316*a* includes the counterpart engagement hook 316*e* that is substantially circular to mate with the engagement hook 318*d*. The compartment lid 318 is positioned with the lid edge 318*a* between the compartment 312 and the counterpart engagement hook or the hook edge 316*e* in the assembled configuration.

The third preferred compartment lid 318 includes a plurality of perforations 319 therethrough that extend through and between the cavity surface 318*b* and the compartment surface 318*c*. The plurality of perforations 319 facilitate the flow of gas and moisture through the compartment lid 318 and the sealing membrane 315. The compartment lid 318 is not limited to including the plurality of perforations 319 therein and may include alternative moisture flow holes or may be constructed of a moisture permeable material that facilitates flow of moisture between the compartment 312 and the storage cavity 306. The compartment lid 318 may also include a single perforation 329, instead of the plurality of perforations 319, as long as moisture is able to flow through the sealing membrane 315 between the compartment 312 and the storage cavity 306. The compartment lid 318 is preferably constructed of the same polymeric material as the cap 310 and the container 301, but is not limited and may be constructed of alternative materials.

Figure 9:
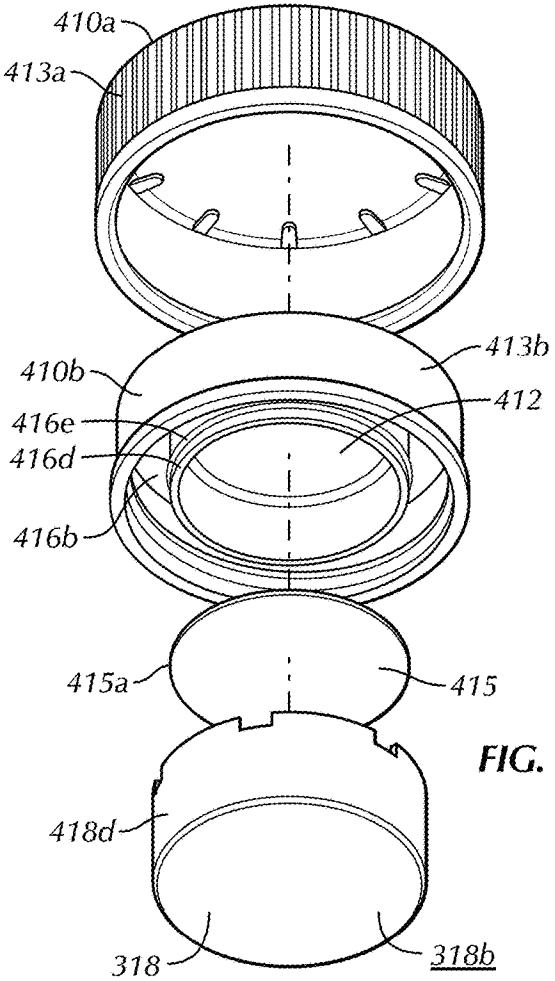
FIG. 9 is a side perspective, exploded view of the cap of the container assembly of FIG. 8.
Figure 8:
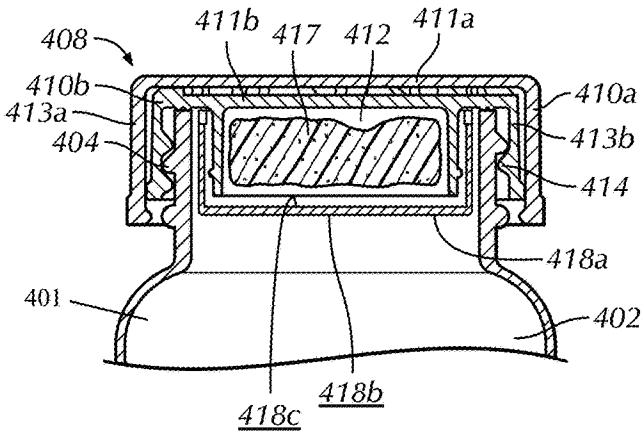
FIG. 8 is a cross-sectional view of the container assembly of FIG. 1, taken along line A-A of FIG. 1 and showing a cap and a container in a mounted configuration in accordance with a fourth preferred embodiment of the present invention.

Referring to FIGS. 1, 8 and 9, a fourth preferred container assembly 408 has a similar construction to the first, second and third preferred container assemblies 8, 208, 308 and like reference numbers are utilized to identify like features of the fourth preferred container assembly 408 with a number "4" prefix utilized to distinguish the features of the container assemblies 8, 208, 308 of the first, second and third preferred embodiments from the container assembly 408 of the fourth preferred embodiment. The fourth preferred container assembly 408 may include a rigid or semi-rigid container 401.

The compartment lid 418 of the fourth preferred embodiment includes a relatively long engagement hook 418*d* that has a length substantially the same as the height of the sidewall 416*a*. The sealing membrane 415 is attached to or positioned against the compartment surface 418*c* in the mounted configuration to facilitate flow of moisture to and between the compartment 412 and the storage cavity 406 to maintain the predetermined relative humidity in the storage cavity 406 for preserving the product in the storage cavity 412. The engagement hook 418*d* is secured to the sidewall 416*a* by engaging the counterpart engagement hook 416*e* and the engagement hook 418*d* spaces the lid edge 418*a* proximate the opening edge 418*d* in the mounted configuration. In the fourth preferred embodiment, the lid edge 418*a*, the engagement hood 418*d* and the engagement hook 416*e* have generally circular configurations, but are not so limited and may have nearly any size and shape to accommodate various sizes and shapes of the compartment 412, the sidewall 416*a* and the compartment lid 418.

The compartment lid 418 of the fourth preferred embodiment has a cup-like shape with a relatively long engagement hook or connector arm 418*d* extending substantially perpendicularly and away from the lid edge 418*a* relative to the cavity and compartment surfaces 418*b*, 418*c*. The connector arm 418*d* connects the compartment lid 418 to the sidewall 416*a* in the assembled configuration. The connector arm 418*d* may be connected to the sidewall 416*a* by a snap lock, heat welding, adhesive bonding, fastening, clamping or another securement mechanism or method that secures the compartment lid 418 to the sidewall 416*a* to secure the moisture controlling material 417 within the compartment 412.

Figure 11:
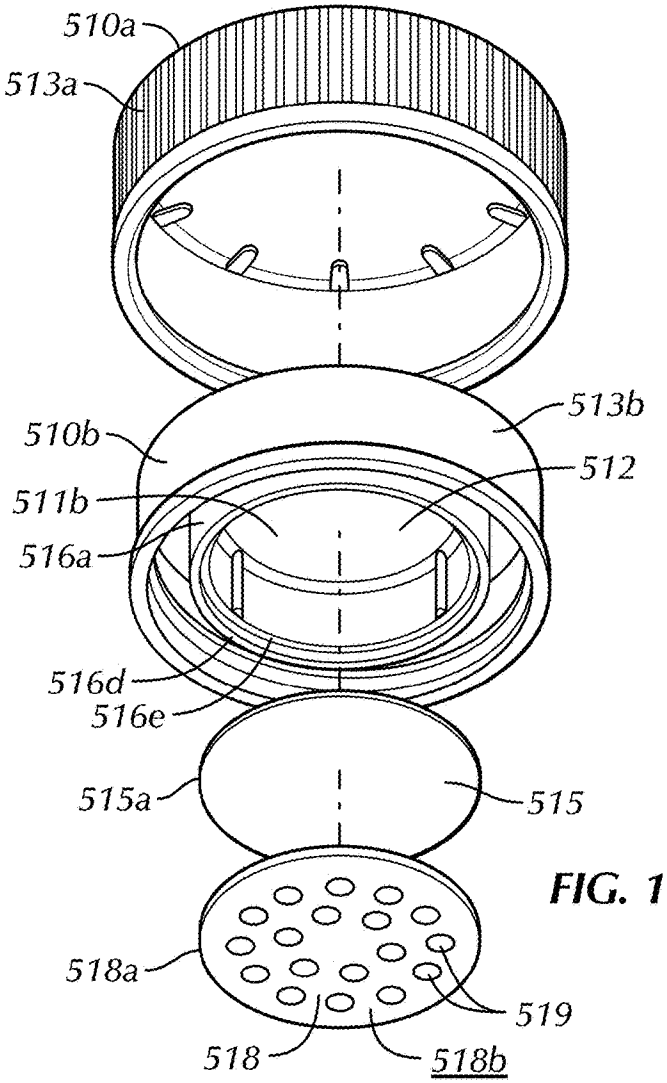
FIG. 11 is a side perspective, exploded view of the cap of the container assembly of FIG. 10.
Figure 10:
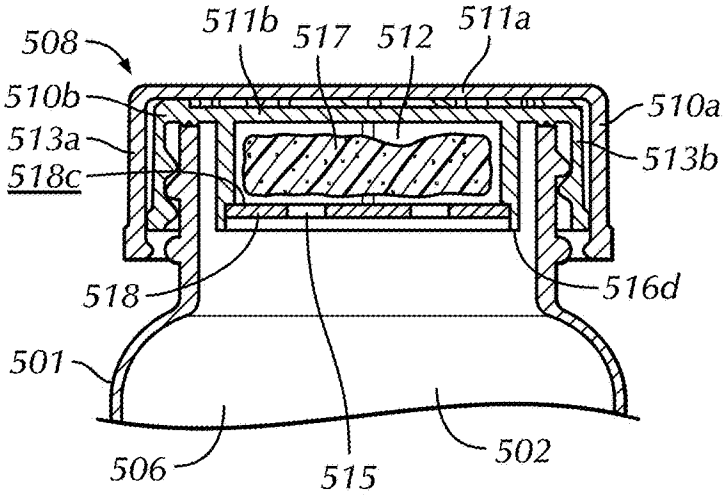
FIG. 10 is a cross-sectional view of the container assembly of FIG. 1, taken along line A-A of FIG. 1 and showing a cap and a container in a mounted configuration in accordance with a fifth preferred embodiment of the present invention.

Referring to FIGS. 1, 10 and 11, a fifth preferred container assembly 508 has a similar construction to the first, second, third and fourth preferred container assemblies 8, 208, 308, 408 and like reference numbers are utilized to identify like features of the fifth preferred container assembly 508 with a number "5" prefix utilized to distinguish the features of the container assemblies 8, 208, 308, 408 of the first, second, third and fourth preferred embodiments from the container assembly 508 of the fifth preferred embodiment. The fifth preferred container assembly 508 may include a rigid or semi-rigid container 501.

The cap 510 of the fifth preferred embodiment includes the compartment lid 518 with the lid edge 518*a* that is positioned adjacent and preferably secured to the peripheral surface or portion 515*a* of the sealing membrane 515. The lid edge 518*a* is sized for an interference or force fit into a cavity at the opening edge 516*d*. The sealing membrane 515 may be secured to the compartment lid 518 or captured between the compartment lid 518 and the sidewall 516*a* in the mounted configuration to secure the moisture controlling material 517 within the compartment 512.

Figure 1A:
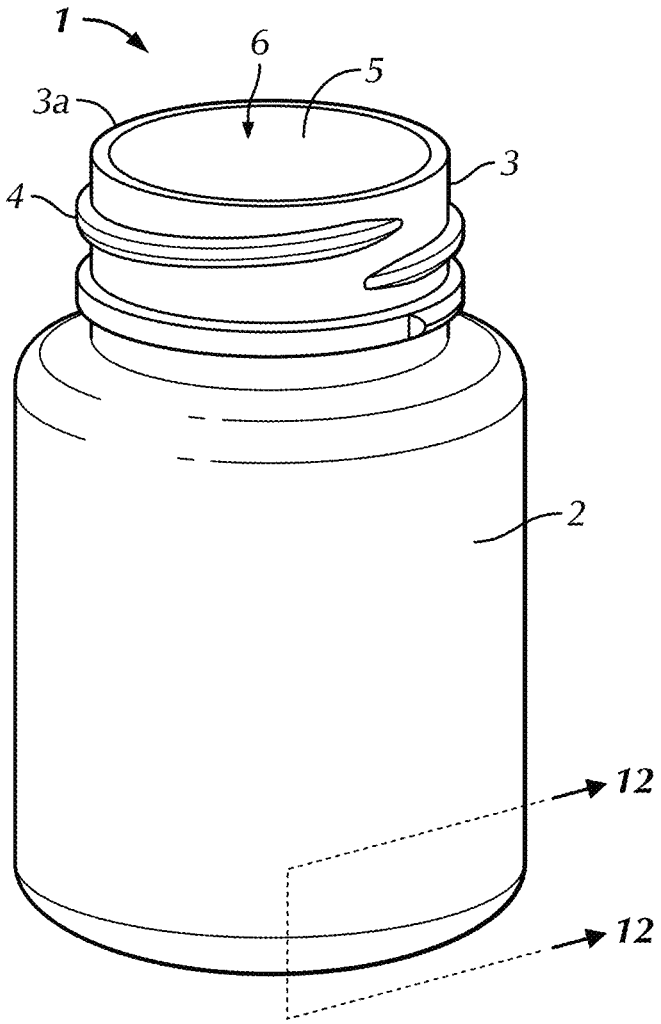
FIG. 1A is a side perspective view of the container of the container assembly of FIG. 1.
Figure 12:
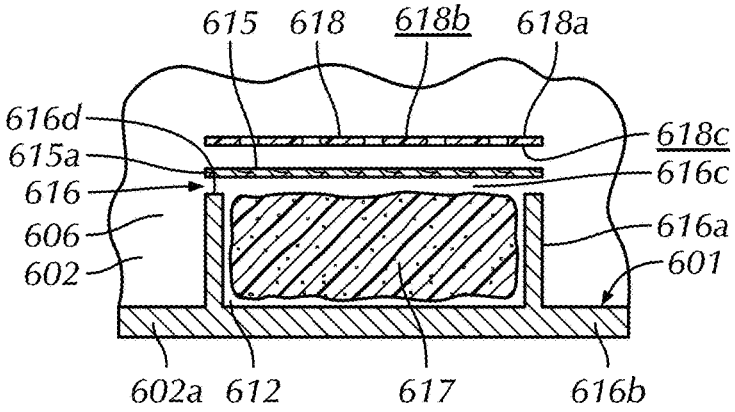
FIG. 12 is a magnified, partial cross-sectional and exploded view of the container of FIG. 1A, taken along line 12-12 of FIG. 1A in accordance with a sixth preferred embodiment of the present invention.

Referring to FIGS. 1, 1A and 12, a sixth preferred container assembly has a similar construction to the first, second, third, fourth and fifth preferred container assemblies 8, 208, 308, 408, 508 and like reference numbers are utilized to identify like features of the sixth preferred container assembly with a number "6" prefix utilized to distinguish the features of the container assemblies 8, 208, 308, 408, 508 of the first, second, third, fourth and fifth preferred embodiments from the container assembly of the sixth preferred embodiment. The sixth preferred container assembly 608 may include a rigid or semi-rigid container 601.

In the sixth preferred embodiment, the compartment 612 is defined by the sidewall 616*a* that is co-molded and extends upwardly, substantially perpendicularly from a bottom body wall 602*a* of the body 602 of the container 601. The sidewall 616*a* and the bottom body wall 602*a* preferably define the compartment 612 with the opening edge 616*a* upon which the sealing membrane 615 is mounted to secure the moisture controlling material 617 within the compartment 612. The sixth preferred container assembly includes the compartment lid 618 that is also secured at its lid edge 618*a* to the opening edge 616*a* to protect the sealing membrane 615 from puncture or wear from the product stored in the storage cavity 606. The sealing membrane 615 is preferably positioned between the compartment 612 and the compartment lid 618, with the compartment lid 618 being moisture permeable for exchange of moisture between the storage cavity 606 and the compartment 612. The sidewall 616*a* is not limited to extending from the bottom body wall 602*a* and may extend from a side body wall 602*a* of the container 601 or from a top portion of the body wall 602*a*, without significantly impacting the function of the sixth preferred container assembly. In addition, the sidewall 616*a* is not limited to being co-molded with the container 601 and may be separately secured, bonded, fastened or otherwise attached to the body wall 602*a* to define the compartment 612 with the sidewall 616*a* extending away from the body wall 602*a* into and toward the storage cavity 606. In the co-molded or separate constructions, the sidewall 616*a* is preferably constructed of a polymeric material, but is not so limited and may be constructed of nearly any material that is able to take on the general size and shape of the sidewall 616*a*, withstand the normal operating conditions of the sidewall 616*a* and perform the preferred functions of the sidewall 616*a*. For example, the sidewall 616*a* may be constructed of metallic, composite, cardboard or other materials.

In the sixth preferred embodiment, the compartment lid 618 includes the lid edge 618*a*, the cavity surface 618*b* that faces the storage cavity 606 in the assembled configuration and the compartment surface 618*c* that faces the compartment 612 in the assembled configuration. The compartment lid 618 is connected or secured to the sidewall 616*a* at the opening edge 616*d* or otherwise on the containment structure 616. The sealing membrane 615 is preferably sandwiched between the lid edge 618*a* and the opening edge 616*d* in the assembled configuration. The compartment 612 is defined by the compartment lid 618, the sidewall 616*a* and a floor of bottom of the body wall 602*a* of the container 601. The sealing membrane 615 and the compartment lid 618 are preferably bonded, fastened, heat welded or otherwise secured to the lid edge 618*a*, but are not so limited. For example, the compartment lid 618 may be releasably mountable to the lid edge 618*a*, such as by mechanical threads, a snap-fit or other releasable mounting mechanisms or methods, such that the moisture controlling material 617 may be removed and replaced from within the compartment 612 to refresh or reenergize the moisture controlling material 617. In addition, the sealing membrane 615 is preferably adhered or otherwise secured to the compartment surface 618*c* of the compartment lid 618, but is not so limited and may be secured to the opening edge 616*d* without the compartment lid 618, may be secured to the cavity surface 618*b*, may be positioned at, but not adhered to the compartment surface 618*c*, or may be otherwise arranged such that moisture may flow between the compartment 612 and the storage cavity 606, but the product within the storage cavity 606 is isolated from the moisture controlling material 617 and generally from escaping the compartment 612 during normal use.

Figure 13:
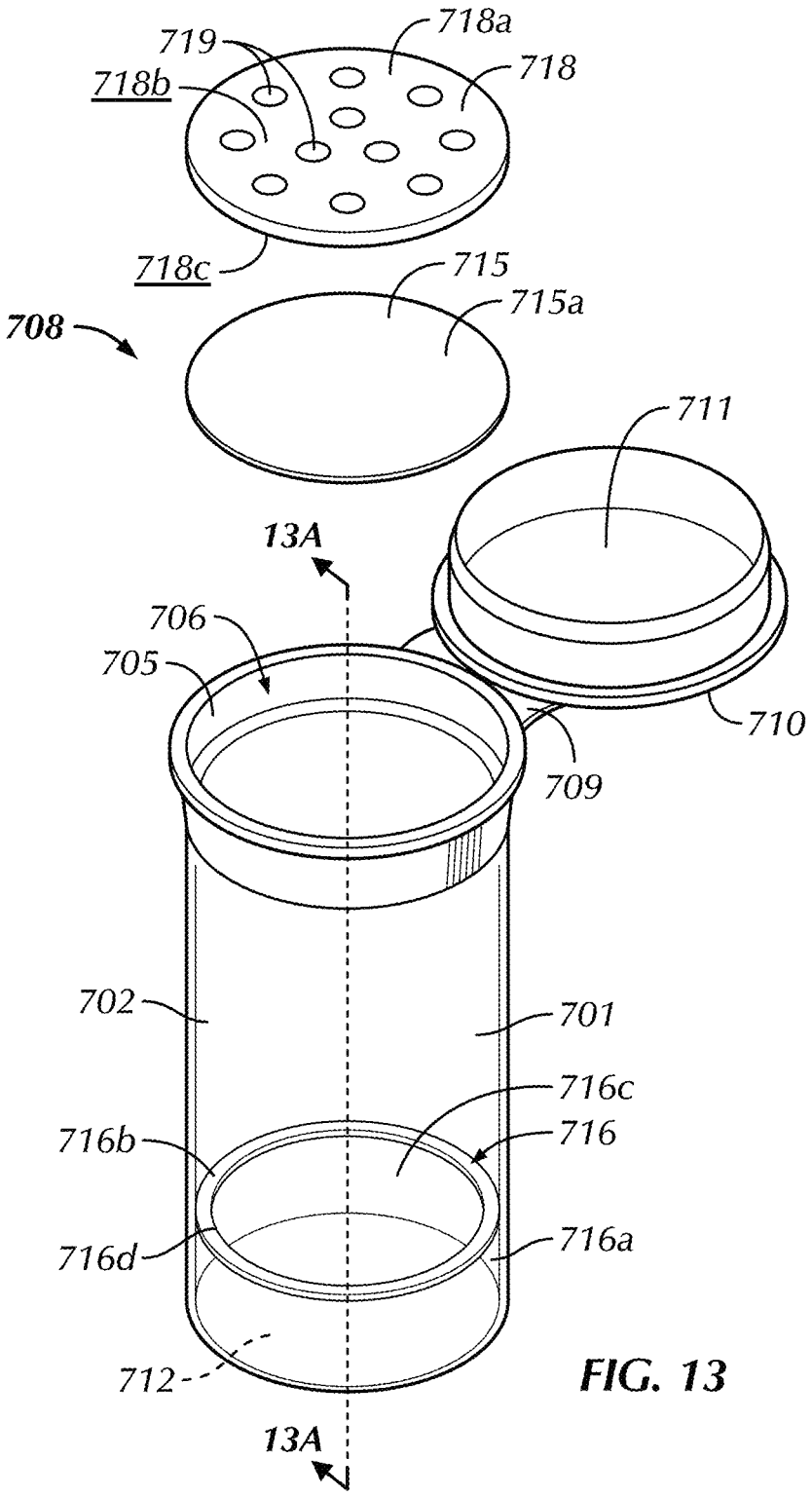
FIG. 13 is a side perspective, exploded view of a container assembly in accordance with a seventh preferred embodiment of the present invention, wherein a container of the container assembly is partially transparent for clarity.

Referring to FIG. 13, a seventh preferred container assembly 708 has a similar construction to the first, second, third, fourth, fifth and sixth preferred container assemblies 8, 208, 308, 408, 508 and like reference numbers are utilized to identify like features of the seventh preferred container assembly 708 with a number "7" prefix utilized to distinguish the features of the container assemblies 8, 208, 308, 408, 508 of the first, second, third, fourth, fifth and sixth preferred embodiments from the container assembly 708 of the seventh preferred embodiment. The seventh preferred container assembly 708 may include a rigid or semi-rigid container 701.

In the seventh preferred embodiment, the container 701 includes the horizontal wall 716*b* extending inwardly from the side of the body wall 702*a* of the body 702 of the container 701. The horizontal wall 716*b* of the containment structure 716 defines the opening 716*c* and the opening edge 716*d* through which the moisture controlling material 717 may be inserted into the compartment 712. The sealing membrane 715 is secured to the horizontal wall 716*b* of the containment structure 716 to enclose the moisture controlling material 717 within the container 701 to regulate the relative humidity within the storage cavity 706. The containment structure 716 preferably includes the horizontal wall 716*b*, the vertical wall 716*a*, which is comprised of a lower portion of the body wall 702*a* The seventh preferred container assembly 708 also preferably includes the compartment lid 718 with perforations 719 therethrough for facilitate moisture flow. The compartment lid 718 is preferably secured to the containment structure 716 to protect the product in the storage cavity 706 from the moisture controlling material 717 and to protect the sealing membrane 715 from the product.

The seventh preferred container assembly 708 includes a living hinge 709 integrally molded between the cap 710 and the container 701 to secure the cap 710 to the container 701. The cap 710 is preferably, releasably snap fit over the mouth 705 of the container 701 to cover the mouth 705 in a closed configuration to secure the product within the storage cavity 706. The container assembly 708 is not limited to including the living hinge 709 to secure the cap 710 to the container 701 and the living hinge 709 may be eliminated without significantly impacting the function of the seventh preferred container assembly 708.

Figure 13A:
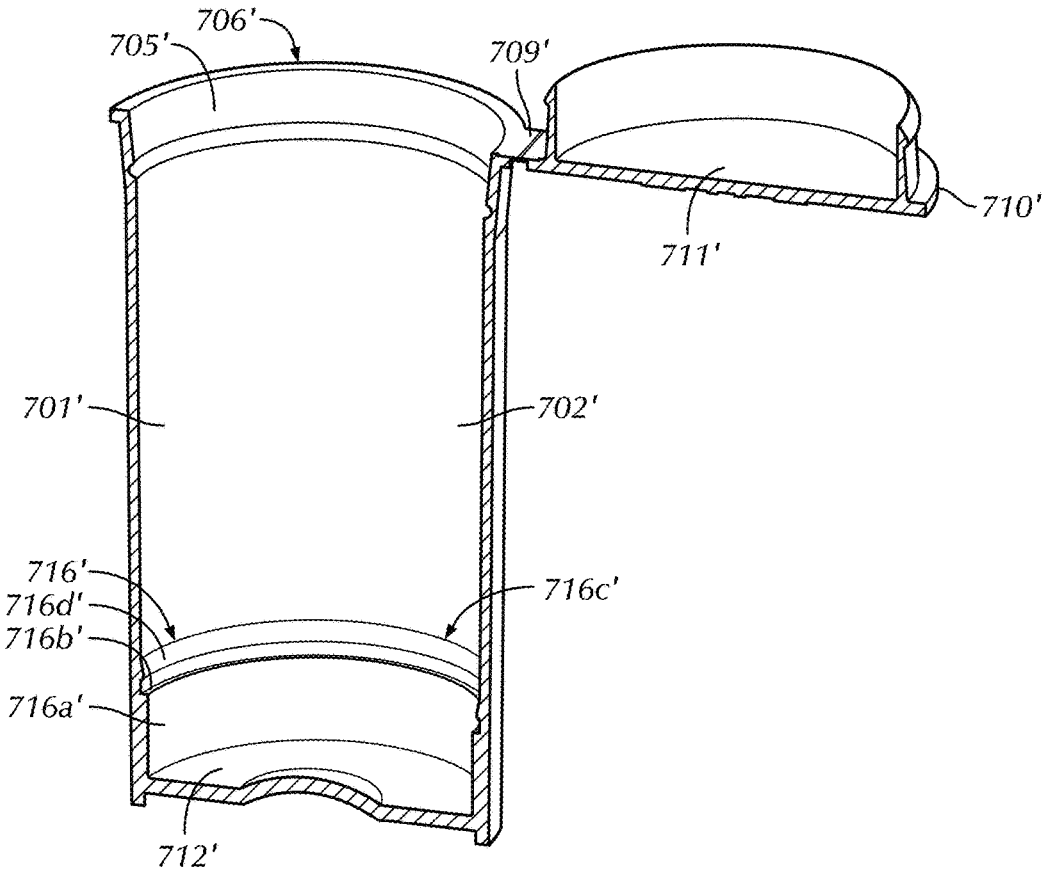
FIG. 13A is a cross-sectional view of an alternative preferred seventh preferred embodiment of the container assembly of FIG. 13, taken along line 13A-13A of FIG. 13 and not showing a sealing membrane and compartment lid for clarity.

Referring to FIG. 13A, an alternative seventh preferred container assembly 708' has a similar construction to the seventh preferred container assembly 708 and like reference numbers are utilized to identify like features of the alternative seventh preferred container assembly 708' with a prime symbol "'" utilized to distinguish the features of the alternative seventh preferred container assembly 708' from the seventh preferred container assembly 708.

The alternative preferred seventh preferred container assembly 708' includes the compartment lid 718 and the sealing membrane 715 of the seventh preferred container assembly 708, although not shown in FIG. 13A. The alternative seventh preferred container 701 includes a groove 716*b*' in place of the horizontal wall 716*b* of the containment structure 716. The groove 716*b*' includes upper and lower ribs that receive the lid edge portion 718*a* therebetween to secure the compartment lid 718 and sealing membrane 715 therebetween. The groove 716*b*' preferably permits a snap-fit or force-fit of the compartment lid 718 therein to secure the compartment lid 718 and the sealing membrane 715 to the container 701. The moisture controlling material (not shown) is positioned in the compartment 712' defined by the compartment lid 718 and sealing membrane 715, the vertical wall 716*a*' and the bottom wall of the container 701. The moisture controlling material preferably assists in maintaining the relative humidity in the storage cavity 706'.

Figure 14:
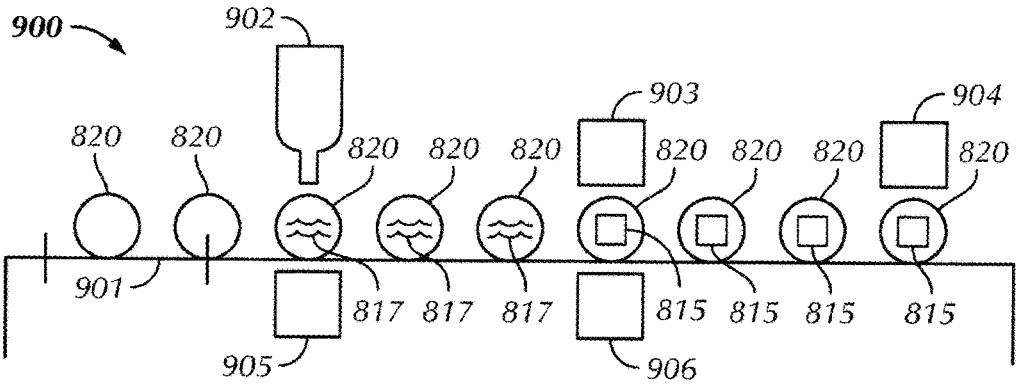
FIG. 14 is a schematic view of a process for manufacturing a humidity control device that may be utilized with any of the preferred embodiments of the container assembly disclosed herein.

Referring to FIG. 14, the container assembly may include a lid 820 configured for covering a jar or the container assembly. A humidity control device process 900 may include applying the humidity control agent or moisture controlling material 817 and the permeable layer or sealing membrane 815 directly to the jar or canister lid 820. For example, a plurality of jar or canister lids 820 may be arranged along a conveyer belt 901 or other moving or stationary system. The humidity control agent or moisture controlling material 817 may be applied or inserted within and on the lid 820 with an extruder 902 or other device. The permeable layer or sealing membrane 815 may be applied by a device 903 configured to cut and/or position the permeable material or sealing membrane 815 over the humidity control agent or moisture controlling material 817 and the lid 820. The sealing membrane 815 may then be heat sealed to the lid 820 using a heater 904 in some embodiments. In other embodiments, the sealing membrane 815 may be sealed to the lid 820 using a different sealing or coupling means, as described above, such as adhesive bonding. One or more registration devices 905, 906 may assist in the process 900.

It will be appreciated by those skilled in the art that changes could be made to the embodiments described above without departing from the broad inventive concept thereof. It is understood, therefore, that this invention is not limited to the particular embodiments disclosed, but is intended to cover modifications within the spirit and scope of the present invention as defined by the present disclosure.

We claim:

1. A container assembly configured to maintain a predetermined humidity for storing a product therein, the container assembly comprising:

a container having a body with a body wall and a mouth opening into a storage cavity;

a cap having a top wall, the cap selectively mountable over the mouth of the container to substantially enclose the storage cavity in a mounted configuration;

a sidewall extending substantially perpendicularly from one of the body wall and the top wall, the sidewall defining an opening and a compartment, the sidewall including an opening edge adjacent the opening;

a compartment lid having a lid edge, a cavity surface and a compartment surface, the compartment lid connected to the sidewall proximate the opening edge with the compartment surface facing the compartment and the cavity surface facing the storage cavity when the cap is mounted to the container;

a moisture control material positioned within the compartment; and a sealing membrane having a peripheral portion, the peripheral portion secured to the sidewall proximate the opening edge, the sealing membrane being secured to the compartment surface of the compartment lid, the sealing membrane configured to allow moisture flow therethrough to maintain the predetermined humidity in the storage cavity.

2. The container assembly of claim 1, wherein the container includes a neck and external threads extending from the neck, the mouth positioned adjacent a top end of the neck.

3. The container assembly of claim 1, wherein the top wall is substantially circular, the sidewall extending from the top wall, a downwardly depending skirt extending from the top wall and positioned outwardly relative to the sidewall, the skirt including an internal surface, internal threads extending from the internal surface.

4. The container assembly of claim 1, wherein the compartment lid has a substantially circular, disc-like shape, the opening edge including a substantially circular hook edge, the compartment lid positioned with the lid edge between the compartment and the hook edge in an assembled configuration.

5. The container assembly of claim 1, wherein the compartment lid includes a plurality of perforations therethrough, the plurality of perforations facilitating the flow of gas and moisture through the compartment lid and the sealing membrane.

6. The container assembly of claim 1, wherein the sidewall extends from the body wall within the storage cavity.

7. The container assembly of claim 1, wherein the opening edge has a melt bead, the melt bead configured for melting upon application of sufficient heat to the peripheral portion to secure the sealing membrane to the sidewall in an assembled configuration.

8. The container assembly of claim 1, wherein the sidewall extends downwardly from the top wall of the cap and is co-molded with the top wall, the top wall and sidewall constructed of a polymeric material.

9. The container assembly of claim 1, wherein the sidewall extends from the body wall into the storage cavity, the sidewall being co-molded with the body wall and constructed of a polymeric material.

10. A container assembly configured to maintain a predetermined humidity for storing a product therein, the container assembly comprising:

a container having a body with a body wall, a neck, external threads extending from the neck and a mouth opening into a storage cavity, the mouth positioned adjacent a top end of the neck;

a cap having a top wall, a downwardly depending skirt with internal threads and a downwardly depending sidewall extending downwardly from the top wall inwardly relative to the skirt, the cap selectively mountable over the mouth of the container to substantially enclose the storage cavity in a mounted configuration by engaging the internal and external threads, the sidewall defining an opening and a compartment, the sidewall including an opening edge adjacent the opening;

a moisture control material positioned within the compartment;

a sealing membrane having a peripheral portion; and a compartment lid having a lid edge, a cavity surface, a compartment surface and a perforation extending between the cavity surface and the compartment surface, the compartment lid connected to the sidewall proximate the opening edge with the compartment surface facing the compartment and the cavity surface facing the cavity, the sealing membrane attached to the compartment surface with the peripheral portion adjacent the lid edge, the sealing membrane configured to allow moisture flow therethrough to maintain the predetermined humidity in the storage cavity.

11. The container assembly of claim 10, wherein the perforation is comprised of a plurality of perforations.

12. The container assembly of claim 10, wherein the compartment lid has a substantially circular, disc-like shape, the opening edge including a substantially circular hook edge, the compartment lid positioned with the lid edge between the compartment and the hook edge in an assembled configuration.

13. The container assembly of claim 10, wherein the compartment lid has a cup-like shape with a connector arm extending substantially perpendicularly away from the lid edge relative to the cavity and compartment surfaces, the connector arm connecting the compartment lid to the sidewall in the assembled configuration.

14. The container assembly of claim 10, wherein the sealing membrane is adhesively bonded to the compartment surface.

15. The container assembly of claim 10, wherein the sidewall is co-molded with the cap and is constructed of a polymeric material.

* * * * *